US009347285B2

(12) United States Patent
Ahlström et al.

(10) Patent No.: US 9,347,285 B2
(45) Date of Patent: May 24, 2016

(54) METHOD AND SYSTEM FOR CONTROLLING A COMPRESSOR AT A ROCK DRILLING APPARATUS AND A ROCK DRILLING APPARATUS

(75) Inventors: Erik Ahlström, Örebro (SE); Erik Aldèn, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 570 days.

(21) Appl. No.: 13/261,587

(22) PCT Filed: Aug. 25, 2011

(86) PCT No.: PCT/SE2011/051027

§ 371 (c)(1), (2), (4) Date: Feb. 4, 2013

(87) PCT Pub. No.: WO2012/026875

PCT Pub. Date: Mar. 1, 2012

(65) Prior Publication Data

US 2013/0140089 A1 Jun. 6, 2013

(30) Foreign Application Priority Data

Aug. 26, 2010 (SE) ..... 1000869

(51) Int. Cl.
*E21B 21/08* (2006.01)
*E21B 21/16* (2006.01)

(52) U.S. Cl.
CPC ..... *E21B 21/08* (2013.01); *E21B 21/16* (2013.01)

(58) Field of Classification Search
CPC ..... E21B 21/08; E21B 21/16
See application file for complete search history.

(56) References Cited

U.S. PATENT DOCUMENTS

| | | | |
|---|---|---|---|
| 3,550,697 | A | 12/1970 | Hobhouse |
| 5,246,079 | A | 9/1993 | Morret |
| 5,388,968 | A | 2/1995 | Wood et al. |

(Continued)

FOREIGN PATENT DOCUMENTS

| | | |
|---|---|---|
| CA | 2437519 | 2/2004 |
| EP | 0 942 173 | 9/1999 |

(Continued)

*Primary Examiner* — David Andrews
(74) *Attorney, Agent, or Firm* — Mark P. Stone

(57) ABSTRACT

The present invention relates to a control of a compressor (8) at a rock drilling apparatus, said rock drilling apparatus including a power source for driving a compressor (8) at a rock drilling process, said compressor (8) being arranged to operate according to a first mode and according to a second mode, wherein, in said first mode, the work produced by the compressor (8) is arranged to be controlled by controlling the rotation speed of said compressor (8), and wherein, in said second mode, the work produced by the compressor (8) is arranged to be controlled by controlling the air flow at the compressor inlet. The method includes determining a parameter value representing a demand of work from said compressor (8), controlling the compressor (8) according to said first mode when said parameter value representing a demand of work from said compressor (8) exceeds a first demand, and controlling the compressor (8) according to said second mode when said parameter value representing a demand of work from said compressor is lower man said first demand. The invention also relates to a system and a rock drilling apparatus.

20 Claims, 5 Drawing Sheets

(56) References Cited

U.S. PATENT DOCUMENTS

| | | | |
|---|---|---|---|
| 5,409,072 | A | 4/1995 | Enlund et al. |
| 5,944,122 | A | 8/1999 | Cheers |
| 6,637,522 | B2 | 10/2003 | Wilson et al. |
| 6,681,875 | B2 | 1/2004 | Larsson et al. |
| 2004/0173379 | A1 | 9/2004 | Leppanen |
| 2007/0246262 | A1 | 10/2007 | Brookover |
| 2009/0071715 | A1 | 3/2009 | Sormunen et al. |

FOREIGN PATENT DOCUMENTS

| | | |
|---|---|---|
| EP | 1 499 818 | 11/2005 |
| GB | 1437442 | 5/1976 |
| SE | 516898 | 3/2002 |
| WO | WO97/47858 | 12/1997 |
| WO | WO03/093699 | 11/2003 |
| WO | WO2005/064111 | 7/2005 |
| WO | WO2009/077656 | 6/2009 |
| WO | WO2009/139743 | 11/2009 |

METHOD AND SYSTEM FOR CONTROLLING A COMPRESSOR AT A ROCK DRILLING APPARATUS AND A ROCK DRILLING APPARATUS

FIELD OF THE INVENTION

The present invention relates to methods and systems for controlling compressors, and in particular to a method for controlling a compressor at rock drilling. The invention also relates to a system and a rock drilling apparatus.

BACKGROUND OF THE INVENTION

A drill tool such as, for example, a drill bit is often used during rock drilling, the drill bit being connected to a drilling machine, in general by means of a drill string consisting of one or more drill rod components. The drilling can be accomplished in various ways, e.g. as rotational drilling where the drill tool is pushed towards the rock at high pressure and then crushes the rock.

Another way of performing the drilling is use of percussive drilling machines, where the drill string is provided with a drill steel shank onto which a piston strikes to transfer percussive pulses to the drill tool via the drill string and then further on to the rock. Percussive drilling is often combined with a rotation of the drill string in order to obtain a drilling where the buttons of the drill bit strikes fresh rock at each stroke (the efficiency of the drilling can be increased by avoiding the buttons of the drill bit from striking holes that have been created by previous strokes. At the same time wear of the drill bit buttons is reduced).

The above drilling methods have in common that the drill remnants, the so called drill cuttings, that are formed during the drilling must be evacuated from the hole so that the drill tool the whole time can work against fresh rock and not waste energy on rock that already has been crushed.

For this reason a flushing medium, such as, for example, compressed air is in general used to flush the drill hole from crushed rock.

The compressed air is obtained from a compressor which, similar to other consumers present at a rock drilling apparatus, is driven by a power source, such as, for example, a combustion engine.

In general, various different consumers are driven by one and the same power source at rock drilling apparatuses, which has the result that the power source at all times must be driven at least at a minimum speed, which is dependent on the consumers being connected to the power source. The speed of the power source must be sufficiently high to ensure that the consumer that at the moment has the highest demand will obtain enough power to ensure desired functionality.

The advantage of such solutions is that one and the same power source can be used as power source for all consumers that are present at the drilling rig, such as compressor, hydraulic pumps/motors, percussion mechanism, etc.

This solution, however, has the disadvantage that many times the actual speed of the power source is not optimal to all consumers. For example, the power demand of the compressor (the demand of compressed air by the rock drilling apparatus) can be lower than the power demand of the percussion mechanism (the hydraulic pump powering the percussion mechanism), which has the result that more power than what is necessary is consumed during a drilling process, with extensive fuel consumption and generation of heat and noise as result.

Consequently there exists a need for an improved control of, consumers at a rock drilling process.

SUMMARY OF THE INVENTION

It is an object of the present invention to provide a method for controlling a compressor at a rock drilling apparatus which solves the above mentioned problem. This object is achieved by means of a method according to claim 1.

The present invention relates to a method for controlling a compressor at a rock drilling apparatus, said rock drilling apparatus including a power source for driving a compressor at a rock drilling process, said compressor being arranged to operate according to a first mode and according to a second mode, wherein, in said first mode, the work produced by the compressor is arranged to be controlled by controlling the rotation speed of said compressor, and wherein, in said second mode, the work produced by the compressor is arranged to be controlled by controlling the air flow at the compressor inlet. The method includes:

- determining a parameter value representing a demand of work from said compressor,
- controlling the compressor according to said first mode when said parameter value representing a demand of work from said compressor exceeds a first demand, and
- controlling the compressor according to said second mode when said parameter value representing a demand of work from said compressor is lower than said first demand.

This has the advantage that the compressor at all times can be controlled in a manner which has the result that the compressor does not consume more power than what is actually required, so that superfluous fuel consumption, and generation of heat and noise associated therewith, can be reduced.

According to the invention the compressor is controlled in such a manner that it generates precisely, or substantially precisely, the work that at present is required, such as, for example, a required flushing air flow. According to the invention this is achieved by selectively speed controlling the compressor (power source) and controlling (throttling) the intake flow at the compressor inlet, respectively, so that the work produced by the compressor (e.g. the delivered flow) can be set to a desired level.

The work produced by the compressor is thus controlled by controlling the rotation speed of the compressor and/or controlling the air flow at, the compressor inlet. This has the result that a very exact control of produced work can be obtained, at a given compressor speed, by throttling the compressor inlet. Precisely to the extent that is required to produce the desired work. The control of produced work can also be performed independent from current speed of the power source for as long as speed of the power source results in a compressor speed where at least a sufficient compressor flow can be discharged.

The work mode of the compressor can continuously change between said first mode and said second mode to ensure that a desired flow is discharged independent from other factors. For example, the demand of flushing airflow can be substantially constant while at the same, time other consumers that are connected to the power source are turned on or off, whereby the rotation speed of the power source can vary during operation, which has the result that a control of the compressor is required to maintain a desired flow.

The compressor can be controlled in a manner that generates a determined pressure on the high pressure side of the compressor, where the flow discharged by the compressor is controlled by the set pressure. The flow on the high pressure side of the compressor, however, will still continuously vary, e.g. in dependence of the resistance that the flushing air is subjected to during drilling. The flow resistance (throttling) depends, inter alia, on the drill bit, type of drill rod, number of drill rods and whether flushing air holes in the drill bit are beginning to get clogged or not. If the amount of drill cuttings produced during drilling is increasing, the flow in the flushing air circuit, in a pressure controlled system, will be reduced as compared to the situation when the amount of produced drill cuttings is comparatively smaller.

These systems, therefore, have the disadvantage that there is no control of the flow. The system strives to maintain a constant set pressure, with the result that the flow that the compressor is set to discharge continuously will vary. The air flow that is required for a given secondary pressure depends completely on the flow resistance that the subsequent system exhibit. This means that one and the same secondary pressure will result in a varying amount of flushing air. When the set control pressure has been reached, the flushing air flow will be reduced as further drill rods are added to the drill string and the hole is getting deeper, which can lead to a pressure increase which in turn leads to reduction of flow with an increased risk of clogging as result. If the flushing air holes in the drill bit are beginning to clog, this throttling, and thereby flow losses, will increase, which leads to the compressor system reducing the flow and the situation getting even worse.

Another object of the present invention, therefore, is to control the flow of the compressor directly instead of controlling the flow discharged by the compressor at a rock drilling process based on a pressure level prevailing after the compressor. This has the advantage that the compressor can be controlled in a manner that results in a solution that is less sensitive to the pressure variations that occur in the flushing air circuit during drilling.

This is achieved by controlling the compressor based on a signal representing a desired flow, where the desired flow is independent from the pressure after the compressor. The control of the flushing air flow is thereby, independent from pressure variations according to the above for as long as the pressure in the flushing air circuit does not exceed a maximum pressure value, which, for example, can be represented by a value at which its assumed that the drill bit has gotten stuck and the drilling hence should be stopped. The maximum pressure can also represent a maximum value that should not be exceeded in order to avoid the risk of components getting damaged.

By controlling the air flow at the compressor inlet and the compressor speed, respectively, the flushing air flow can be controlled independent from the actual pressure that prevail in the flushing circuit. This means that the compressor load will vary independence of the pressure, while the flow is kept a desired level (at least up to the set maximum load of the system according to the above). This means that the desired flushing air flow can be very precisely controlled and independent from variations in load, whereby it can be ensured that a desired flushing air flow to be discharged by the compressor is maintained at all times.

A flush controlled system, as opposed to a pressure controlled system, can deliver a constant flow (within the pressure limitations of the system) that is independent from the counter-pressure that drill string components etc. are generating. This means that the flushing air flow will not vary with the number of drill rods or hole depth (unless an increase in flushing air flow with an increasing number of drill string components, i.e. increased hole depth, is desired, in which case such increase can be set).

The pressure can thus vary with the flow and not vice versa, which makes it possible to use the flushing air pressure to determine if any problems arise, e.g. if the drill bit is getting clogged.

Further characteristics of the present invention and advantages thereof will be apparent from the following detailed description of exemplary embodiments and the appended drawings.

DETAILED DESCRIPTION OF EXEMPLARY EMBODIMENTS

Figure 1:
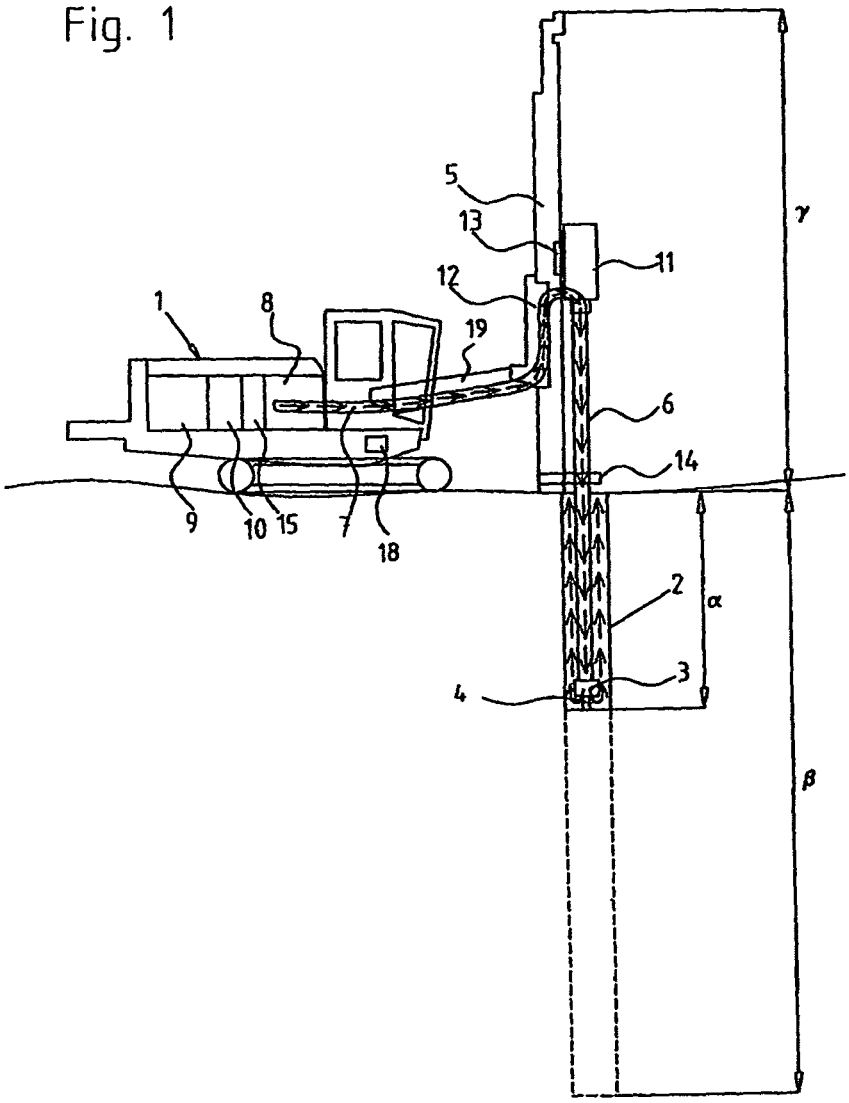
FIG. 1 discloses a rock drilling apparatus at which the present invention advantageously can be utilized.

FIG. 1 shows a rock drilling apparatus according to a first exemplary embodiment of the present invention for which an inventive control of a compressor will be described.

The rock drilling apparatus shown in FIG. 1 includes a drilling rig 1, in this example a surface drilling rig, which carries a drilling machine in the form of a top hammer drilling machine 11.

The drilling rig 1 is shown in use, drilling a hole 2 in rock, which starts at the surface and where the drilling at present is at a depth $\alpha$. The hole is intended to result in a hole having the depth $\beta$, which, depending on area of use, can vary to large extent from hole to hole and/or from area of use to area of use. The finished hole is indicated by dashed lines. (The shown relationship between drilling rig height and hole depth is not intended to be proportional in any way. The total height, $\gamma$ of the drilling rig can, for example be 10 meters, while, the hole depth $\beta$ can be both less than and considerably larger than 10 meters, e.g. 20 meters, 30 meters, 40 meters or more).

The top hammer drilling machine 11 is, via a drill cradle 13, mounted on a feed beam 5. The feed beam 5, in turn, is attached to a boom 19 via a feed beam holder 12. The top hammer drilling machine 11 provides, via a drill string 6 being supported by a drill string support 14, percussive strokes onto a drill tool in the form of a drill bit 3. A drill bit, in general, includes cutters or bits/buttons of hard metal, diamond or the like, which transfer shock wave energy from the top hammer drilling machine 11 onto the rock. For practical reasons (except possibly for very short holes) the drill string 6 does not consist of a drill rod in one piece but consists, in general, of a number of drill rods. When the drilling has progressed a distance corresponding to a drill rod length a new drill rod is threaded together with the one or more drill rods that already has been threaded together, whereby drilling can progress for another drill rod length before a new drill rod is threaded together with existing drill rods.

The top hammer drilling machine 11 is of hydraulic kind, whereby it is power supplied by a hydraulic pump 10, which, in turn, is driven by a power source in the form of a combustion engine 9 (such as, for example a diesel engine) via tubes (not shown) in a conventional manner. Alternatively, the power source 9 can, for example consist of, e.g. an electric motor.

In general, a drilling rig of the above kind includes a primary power source, such as the combustion engine 9, which provides power to various or all of the consumers present at the drilling rig, such as, e.g. compressor, hydraulic pumps as well as consumers driven by such, such as, for example, percussion mechanism, hydraulic motors.

During drilling the rock is crushed, and the crushed rock form drill remnants that have to be evacuated from the drill hole in order for the drilling to be performed in an efficient manner.

For this reason a flushing medium is used, according to the present example compressed air, flushing air, to flush the drill holes clean from the drill remnants, also called drill cuttings, being generated during drilling (instead of using compressed air other flushing mediums can be used as well, for example water, with or without an additive).

In the disclosed rock drilling apparatus flushing air is led through the drill rods, which consist of thick walled tubes, e.g. made from steel. A channel through the drill string formed in or through the rod walls in the longitudinal direction is used to feed flushing air from the drill rig 1 through the drill string 6 for release through flushing air holes in the drill bit to thereafter bring drill cuttings on the way up through the hole.

The flushing air flushes the drill cuttings upwards through and out of the hole 2 in the space between drill rod and drill wall as is indicated by the upwardly directed arrows in FIG. 1 (in an alternative embodiment the drill cuttings are flushed out from the hole through a channel in the drill string, whereby the flushing medium is led through the hole in the space formed between drill rod and drill wall, alternatively through a second channel formed in the drill string).

Irrespective of flow path it is required, in order for the drill cuttings to follow the flushing air up through the hole, that the flushing air reaches at least a certain speed. This minimum speed that is required for the drill cuttings to follow the flushing air up through the hole and not remain in the hole with clogging problems as a consequence, depends primarily on the size, form and density of the drill cuttings. It is important that the air flow is sufficiently high for the drill cuttings to follow the air flow to the surface. A flow that, is too low can deteriorate drilling performance, and at worst lead to the drilling getting stuck. At the same time it is important that the air flow is not unnecessarily high, since a too high flow leads to an increased energy consumption and also to increased wear of, for example, drill string casting due to the blasting effect the drill string is subjected to by the drill cuttings being carried by the flushing air up through the hole.

In order to get air down to the drill bit a compressor 8 is used, in the present example a screw compressor, which presses flushing air through the channel in the drill rods down to the drill bit. The compressed air is fed to the drill string 6 from the compressor 8, directly or via a tank (not shown), or via a hose 7. The compressor 8 is driven, as mentioned, by the combustion engine 9, and the function of the compressor 8 will be described more in detail below in connection to FIG. 2*a-b*.

The combustion engine 9 is the primary power supply means of the drilling rig and should therefore be sufficiently powerful to simultaneously power both the compressor 8 and other consumers connected to the combustion engine, such as hydraulic pumps 10, 15 at full speed, as well as cooling fans and other consumers. These other consumers can, for example, consist of further hydraulic pumps for powering other hydraulically controlled functions of the rock drilling apparatus that are in operation during drilling conditions where maximum power takeout is required.

The drilling rig also includes a control unit 18, which constitutes part of the drilling rig control system, and which can be used to control various functions, such as, for example, controlling the speed of compressor 8 and combustion engine 9 according to the present invention, and which will be described below.

As was mentioned above, the compressor consists of a screw compressor, i.e. a compressor having a fixed displacement. In FIG. 2 the compressor 8 is shown as directly connected to the combustion engine 9, i.e. a change in combustion engine speed is directly reflected by a corresponding change in the rotation speed of the compressor 8.

The flow from a compressor having fixed displacement can, in principle, be controlled according to two different principles, where one consists of controlling the rotation speed of the compressor. The flow from a compressor having fixed displacement is directly proportional to the compressor speed, and in situations where the power source of the compressor can be freely speed controlled the flow delivered by the compressor can also be controlled to an arbitrary level between 0 and 100% of the capacity of the compressor by controlling the speed. The compressor and/or the power source can, however, have a minimum speed, whereby the possible lower limit for speed control in reality often consists of a minimum speed, which also imposes a restriction in regard of the minimum flow that the compressor can deliver by controlling the speed.

A completely free speed control is many times not possible, for example since a power source in the form of a combustion engine must maintain at least a minimum (idling) speed in order to be running. With regard to rock drilling apparatuses according to the above there are also other consumers connected to the power source; such as said hydraulic pumps 10, 15, which, in order to obtain enough power, can require a higher combustion engine speed than what is presently required by the compressor.

The rotation speed of the combustion engine is therefore controlled by the control unit 18 by means of a control signal 24, which is determined by the control unit 18 based on signals 21-23 from, for example, other consumers, or another control unit being present at the rock drilling apparatus, and where the control signals can represent a power requirement of the compressor and/or one or more other consumers.

The combustion engine 9 can also be arranged to be driven at any of a number of different, substantially constant speeds, which are adapted for different operating conditions. Speed control according to the invention, consequently, can include a completely free speed control of the compressor (power source) for as long as the speed does not go below the lowest speed that is required by other consumers, but also control to any of a number of predetermined speeds.

Figure 2A:
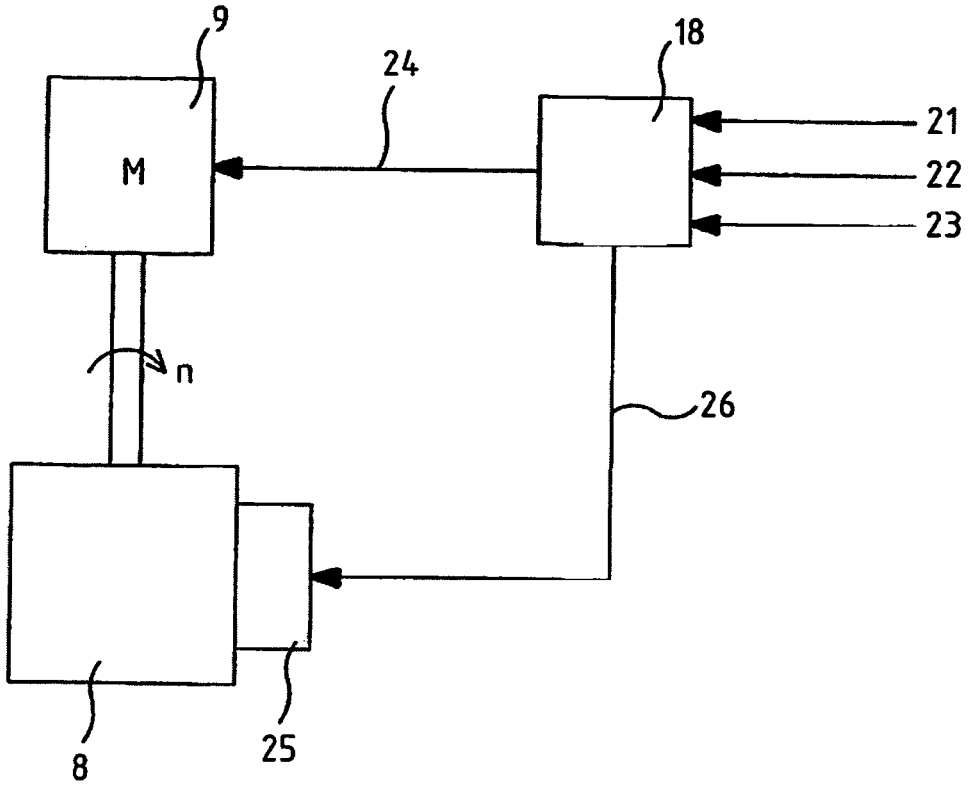
FIG. 2*a-b* discloses a device for controlling an air compressor at the rock drilling apparatus of FIG. 1 according to one exemplary embodiment of the present invention.

However, according to the present invention not only speed control of the compressor is used. Instead, a compressor control method is used where, two different principles are alternately used to control the compressor in order to obtain a delivered work from the compressor, such as a flow corresponding to a desired flow/flow requirement. Apart from controlling the speed of the combustion engine 9 according to the above, the amount of air supplied to the compressor is also controlled. This is schematically illustrated in FIG. 2*a* by means of an inlet valve 25, the opening/closing of which is controlled by means of a control signal 26 from the control unit 18.

Figure 2B:
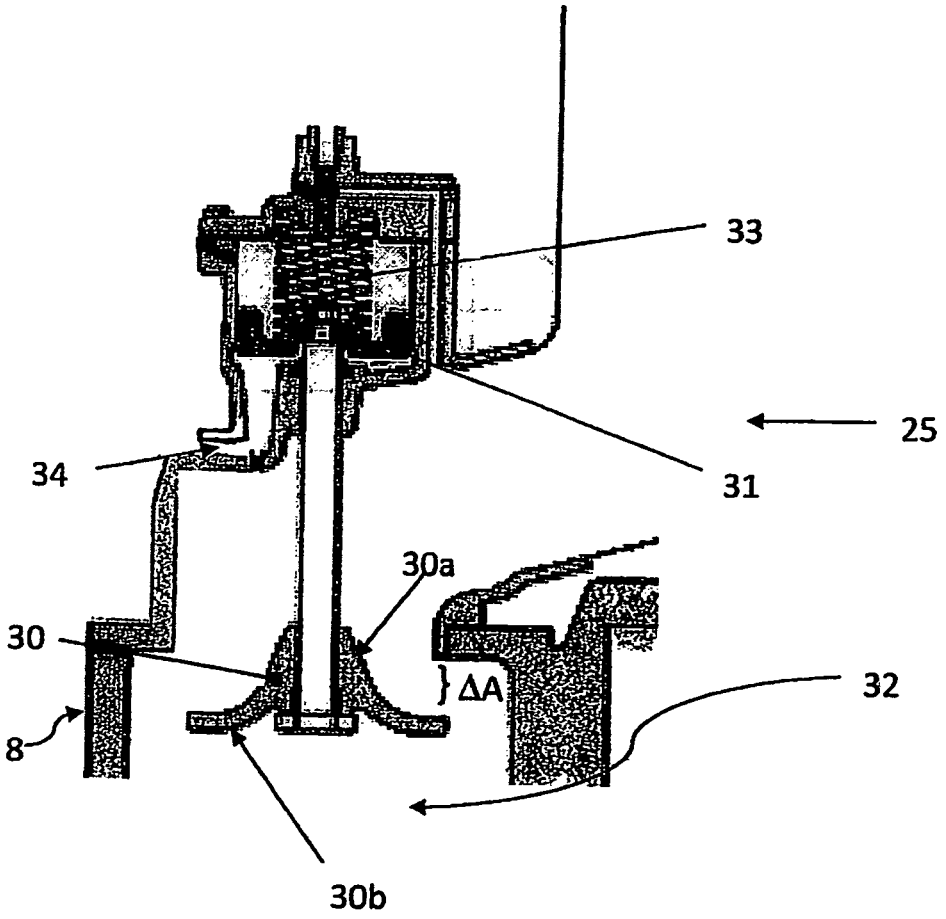

The principle for controlling the flow discharged by the compressor 8 by means of the inlet valve 25 is shown more in detail in FIG. 2*b*.

The inlet valve 25 consists of an electrically controlled inlet valve. It is to be understood that control of the compressor inlet, in general, can be accomplished in various ways and by means of different kinds of inlet valves. According to the shown exemplary embodiment the valve is exemplified by an electrically controlled proportional valve in the inlet of the compressor.

According to the embodiment shown in FIG. 2*b* the valve is a disk valve having a valve disk 30, which is maneuvered by means of a pneumatically controlled control piston 31. The opening area ΔA towards the compressor inlet 32 is changed by maneuvering the valve disk 30 up and down by means of the control piston, and thereby the amount of air that is allowed to pass from the surroundings to the compressor inlet 32 is also changed.

The side 30*a* facing away from the inlet (i.e. the upper side in FIG. 2*b*) of the valve disk 30 act against the pressure of the surroundings, which in general is the atmospheric pressure $p_{atm}$, while the opposite (lower) side is affected by the prevailing pressure $p_{in}$ in the compressor inlet 32. The valve disk 30 functions as a throttling, whereby the pressure in the compressor inlet at most will correspond to $p_{atm}$, but as soon as air can not flow freely into the compressor inlet a subpressure $p_{in}<p_{atm}$ will prevail in the compressor inlet 32.

The air flow from a compressor at a given compressor speed is at least substantially linearly, dependent on the absolute pressure in the inlet. In case the compressor works against atmospheric pressure, i.e. when the inlet pressure $p_{in}=p_{atm}$, 100% of the maximum flow capacity of the compressor at current speed at current circumstances is obtained. On the other hand, as soon as a negative (under)-pressure prevails at the compressor inlet, the flow discharged by the compressor will constitute a partial flow of the maximum flow. The flow discharged by the compressor can be controlled to precisely a desired pressure by controlling the negative pressure in the compressor inlet in a controlled and desired way by means of electrical control signals to the inlet valve.

The pressure difference that the valve disk is subjected to according to the above gives a rise to a force (directed downwards in FIG. 2*b*) which is linearly dependent of the negative pressure in the inlet. In order to control the valve disk, a control piston 31 that is mechanically connected to the valve disk is used in the disclosed embodiment.

The control piston 31 is pressure controlled, and for as long as the control piston is relieved from a pressure point of view, the inlet of the compressor is kept open by means of a spring 33. If a force is applied to the control piston 31 via a channel 34, and thereby the valve disk 30, the valve disk 30 will position itself in such a manner that an equilibrium of forces between flow forces, spring force (the spring force can be small in relation to other prevailing forces, whereby this force at least in some cases can be disregarded) and the force applied by the control piston 31. Consequently, the negative pressure that the valve disk gives rise to will be dependent on the control force. By means of a knowledge of the spring characteristics of the spring 33, which, e.g., can be measured or obtained from the spring manufacturer, the negative pressure can be controlled to a desired level in a simple manner by pressurizing the control piston, where the spring characteristics are taken into consideration during the control.

Control of the inlet valve can be accomplished in any suitable way, and in the solution exemplified herein an electrically controlled pneumatic spring loaded control piston is consequently used to control of the valve disk, but fully electrical or hydraulic solutions to control the valve disk are contemplated. The valve can also be of a completely different design than the one disclosed herein.

The control piston pressure is controlled by means of an actuator, such as an electrically controlled valve, whereby control signals 26 from the control unit 18 controls the electrically controlled valve 25, and thereby the control piston, according to FIG. 2*a-b*.

Consequently, it is possible to control the flow of a compressor according to two different principles. Even if these two principles result in the same function, i.e. a possibility to control the flow discharged by the compressor to a desired flow in a desired manner, speed control and control of pressure (flow) at the compressor inlet, respectively, exhibits a large difference in efficiency at partial loads.

Figure 3:
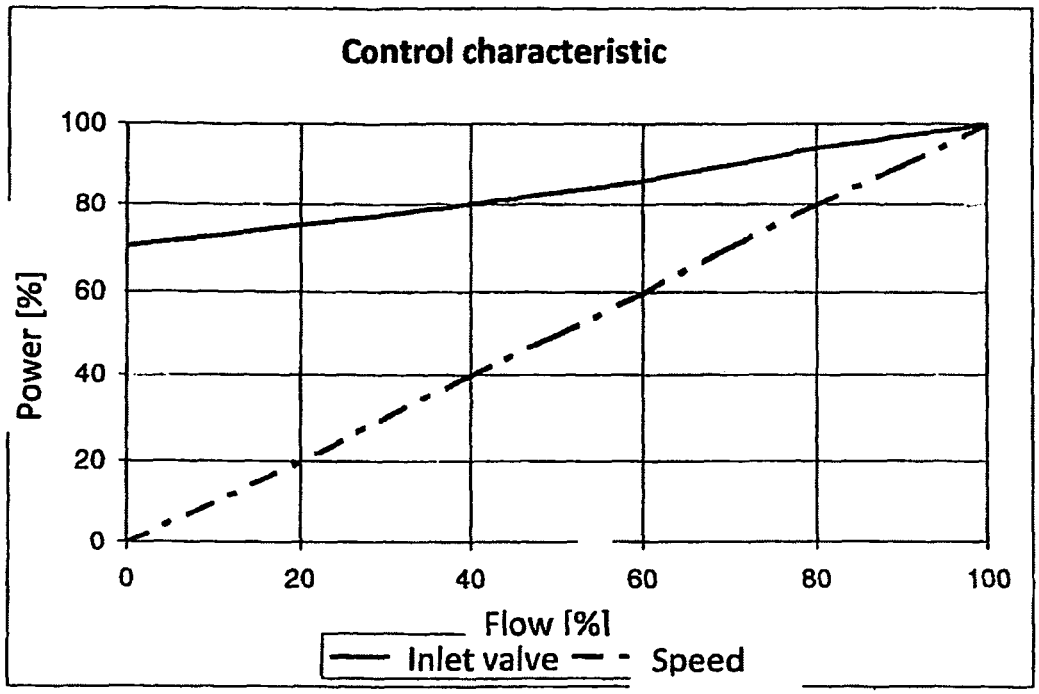
FIG. 3 shows the efficiency of a compressor when being speed controlled and when being controlled by controlling air flow at the compressor inlet, respectively.

This is, exemplified in FIG. 3. FIG. 3 discloses a graph over the power requirement of the two control principles at 0-100% load of the compressor. A flow of 100% represents a first speed $n_x$. The speed $n_x$ can be, but must not necessarily be, the maximum speed of the compressor.

Controlling by means of speed control thus means a control of the compressor speed from 0 (0% flow) to $n_x$ (100% flow). A control of the intake air, on the other hand, consists of a control at the speed that results in 100% flow, i.e. the graph representing control of the inlet valve in FIG. 3 consist of a control where the compressor speed is constant $n_x$. The disclosed relationship is always valid, i.e. the efficiency when controlling the compressor to deliver a certain flow by speed control is always higher compared to controlling the compressor to deliver a certain flow by controlling the intake air at the compressor inlet.

Consequently, it would be desirable to always speed control the compressor all over the (working) range where the compressor in general is working during operation. According to the above, however, this is in general not possible at rock drilling apparatuses, since speed control, all over the working range of the compressor is only possible in case no other consumers that are connected to the compressor power source (combustion engine 8) depend on the power source continuously maintaining at least a certain speed.

According to the present invention, therefore, the compressor is either controlled according to a first mode, where the compressor is speed controlled, or according to a second mode, where the air flow in the compressor inlet is controlled.

Figure 4:
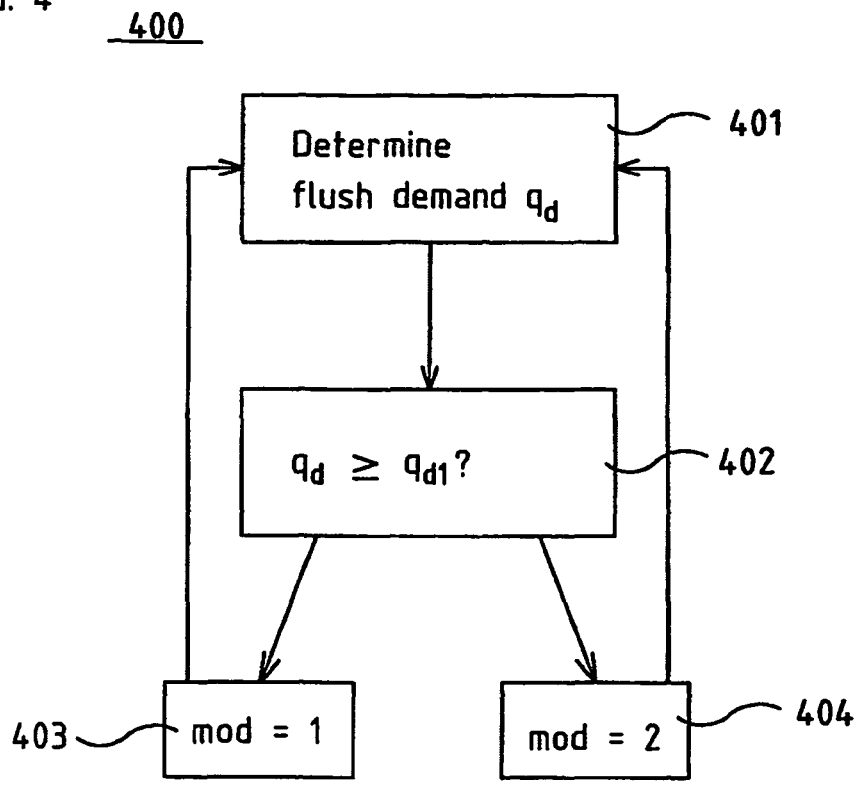
FIG. 4 shows a flow chart of an exemplary method according to the present invention.

An exemplary method 400 according to the present invention is disclosed in FIG. 4.

The method starts in step 401, where a compressor flow demand $q_d$ is determined. The demand for compressors flow $q_d$ can vary to a large extent, and be determined in different manners. The demand can, for example, be controlled based on a desired pressure after the compressor, in which case a pressure sensor downstream the compressor can be, used to determine if the flow discharged by the compressor is to be increased or decreased in order for the desired pressure to be maintained.

According to one embodiment of the present invention, control of the compressor 8 is completely flow controlled, in this case the flow that the compressor is to discharge is determined, the compressor then being controlled in such a manner that the desired flow is obtained. Flow control of the compressor has the advantage that no feedback from the flow circuit downstream the compressor is required, i.e. since the compressor at all times will deliver a certain flow at a certain rotation speed and a certain valve position it can always be ensured that a desired flow is discharged.

Flow control further has the advantage that by only controlling the flow delivered by the compressor 8, a desired flow can be maintained independent from actual load (which, e.g., depends on the current number of drill string components and the amount of drill cuttings that at present is being produced during drilling) and also the pressure that actually is required in order to obtain the desired flow. When the load of the flushing air circuit increases, e.g. due to an increased amount of drill cuttings, or when more and more drill string, components are added to the drill string as the drilling progress, the compressor will work harder, i.e. still discharging the flow determined by the control signal, but at a higher, pressure for as long as the maximum allowed pressure is not exceeded according to the above.

Accordingly, control of the compressor flow can be performed independent from the actual flushing air pressure that prevail in the flushing air circuit whereby a control of the flushing air pressure during flow control is not required either. It is, however, still advantageous to monitor the pressure in the flushing air circuit, e.g. by means of a pressure sensor, so that the compressor flow can be stopped or lowered to a reduced flow if the load becomes so high that a predetermined maximum pressure of the compressor or flushing air circuit is exceeded. In this case the drilling can also be stopped or reduced, since the pressure increase can be due to the flushing air channel being clogged or about to be clogged.

When a suitable compressor flow has been determined in step 401 the method continues to step 402, where it is determined if the required compressor flow $q_d$ exceeds a parameter value $q_{d1}$ to determine a working mode of the compressor. This determination is performed in one embodiment by determining if the required flow $q_d$ exceeds a first value, e.g. 40, 50, 60, 70 or 75% of the maximum flow that the compressor can deliver (it is to be understood that by this is meant the maximum flow that the compressor can deliver in the current, installation. The compressor itself can be designed to deliver a higher flow should it be driven by another power source, such as, e.g., a power source being capable of driving the compressor at a higher speed).

If this is the case the method continues to step 403, where the compressor is controlled according to said first mode, i.e. rotation speed controlled and set to deliver a flow $q_d$ If the combustion engine can be set to a number of fixed speeds, and hence not be freely speed controlled, the compressor can be set to discharge the flow that is obtained at the nearest fixed speed that exceeds the speed being required to deliver the flow $q_d$.

If, on the other hand, the required flow $q_d$ is less than said first value, the method continues to step 404 for control according to said second mode, i.e. control of the flow at the compressor inlet, where the inlet valve is set to discharge a desired flow $q_d$.

It is to be understood that the control of the compressor can be continuous, and that changes between said first mode and said second mode can be performed often. The determination of required flow can, for example, be performed every second, every 5 second, every 10 second or by any other suitable interval. The method therefore returns from steps 403, 404, e.g. after a certain time according to the above has lapsed, to step 401 for a new determination of the flow demand.

It is further to be understood that the transition boundary between rotation speed control and control of flow at the compressor inlet can be restricted by limitations, such as the fact that the power source many times must maintain a minimum speed, whereby this minimum speed controls the boundary for changing between flow control at the compressor inlet and rotation speed control, respectively. The rotation speed can, for example, be anywhere in the rotation speed interval that results in the compressor discharging 40-95% of maximum flow.

Instead of using a fixed boundary for said parameter value $q_{d1}$ when choosing between said first and second mode, respectively according to the above, a variable value of $q_{d1}$ is used according to one exemplary embodiment of the present invention. According to this embodiment, the compressor is controlled according to the following:

The compressor will be operated according to said first mode when a desired flushing air flow $q_d$ [expressed in % of the maximum flow that can be discharged by the compressor] equals or exceeds a first value $q_{d1}$ (expressed in % of the maximum flow of the compressor), where:

$$q_{d1} = \frac{\omega_{e_min}}{\omega_{e_max}} * 100, , \tag{1}$$

and where:

$\omega_{e_max}$=maximum motor (compressor) speed, $\omega_{e_min}$=lowest motor (compressor) speed, i.e. the lowest rotation speed that is required by other consumers or the lowest combustion engine rotation speed that allows compressor operation. This speed, and hence $q_{d1}$ can consequently be changed during operation.

Consequently, this means that the combustion engine will be operated at a higher speed than $\omega_{e_min}$ as soon as $q_{d1}$ exceeds the boundary according to eq. (1) above.

The rotation speed $\omega_e$ of the combustion is then controlled according to $$\omega_e = \omega_{e_max} * \frac{q_d}{100},$$

at the same time as the flow in the compressor inlet is set to $q_i$=100, i.e. fully open inlet.

If, on the other hand, $$q_d < \frac{\omega_{e_min}}{\omega_{e_max}} * 100$$

the combustion engine is controlled such that $\omega_e = \omega_{e_min}$, i.e. at the least possible (other consumers taken into consideration) rotation speed of the power source, at the same time as the flow $q_i$ passed the inlet, valve [% of max] is controlled according to said second mode such that the compressor flow becomes:

$$q_i = \frac{q_d}{\frac{\omega_{e_min}}{\omega_{e_max}}} \tag{2}$$

A desired flow from the compressor can consequently be obtained by controlling $q_i$. Depending on, for example, engagement/disengagement of other loads/consumers being driven by the power source the rotation speed $\omega_{e_min}$ of the power source can vary. The power source can be arranged to be operated at any of a plurality of predetermined substantially fixed rotation speeds, where the different speeds are adapted to deliver enough power to connected consumers in relation to the presently prevailing demands. The percussion mechanism and rotation of the drill string constitutes examples of consumers the power supply of which should not be affected by the speed control of the compressor.

However, according to one embodiment $\omega_{e_min}$ above can consist of a speed $\omega_{e_ober}$, where it can be ensured that the speed of the power source can be changed without affecting rig functionality for as long as the speed of the power source does not fall below $\omega_{e_ober}$.

This can be accomplished by dimensioning other consumers being connected to the primary power source in such a manner that they become independent of the rotation speed for speeds exceeding $\omega_{e_ober}$. Rotation speed independence of the hydraulic system in the chosen speed range can be obtained by dimensioning and adapting pumps and pump control of the hydraulic system. This means that other consumers being connected to the power source can be operated at full power, or at least the maximum power that the consumers are required to deliver, i.e. the power that at most will be required by the consumer in the system at hand (e.g. current drilling rig) already at $\omega_{e_ober}$. Other consumers can, for example, be dimensioned such that they, at a power source speed $\omega_{e_ober}$, e.g. 70-75% of the speed $\omega_{e_max}$ at which said compressor discharges maximum flow, can deliver full power or at least the maximum power that the consumers are required to deliver. The power that can be delivered by a consumer is many times dependent on the rotation speed, but by dimensioning the consumer in a suitable manner it can be ensured that the maximum required power can be delivered already at the speed $\omega_{e_ober}$.

Consequently, speed control of the compressor can be performed from about 70-75% to 100% flow without, other consumers being affected. $\omega_{e_ober}$ can also consist of other speeds, and, for example, be a speed in the range 40-95% of said speed $\omega_{e_max}$.

In one embodiment $\omega_{e_ober}$ is fixed, but as has been shown above, the speed range can be controlled by current demands. If all subsystems are operated in a operating point that is lower than a maximum operating point, the control system can continuously adapt the engine speed to the sub system that at present has the largest demand, i.e. $\omega_{e_min}$ above, whereby the speed limit that constitutes the limit between speed control and flow control can vary according to what has been described above also in an embodiment where other consumers are speed independent for a certain speed $\omega_{e_ober}$.

When controlling according to said second mode, the control unit 18 takes the speed of the power source (combustion engine) into consideration in eq. 2, whereby a desired flow can be ensured independent from variations in the rotation speed of the power source. The rotation speed of the power source can, for example, be obtained by a speed sensor arranged at the output shaft of the power source or at an input shaft of the compressor.

A determination of the flow that the compressor is to deliver according to the above can be based on one or more different parameters.

For example, a determination of flushing air flow can be determined based on the current depth of the drill hole (it can be advantageous to increase the flow with increasing hole depth, but it is to be understood that one and the same flow can also be used when drilling a hole).

The flow of the compressor can also, fully or partly, be based on the percussion mechanism power (percussion pressure and/or percussion frequency) of the drilling machine such that, irrespective of percussion mechanism power, it can be always be ensured that the flow is adapted to the drill cuttings being generated during drilling, since harder drilling (a higher percussion frequency) often results in the generation of larger amounts of drill cuttings.

The flushing air flow can, of course, also be controlled independent from the percussion pressure. The nature of the rock can also be taken into consideration, whereby the flushing air flow can be controlled at least partly in dependence of the nature of the rock in which drilling is carried out.

The control of the flow being delivered by the compressor can also be based on an arbitrary combination of the above or further control parameters, such as a representation of the rotation speed of the drill tool, hole diameter and/or drill string diameter.

During the automatic control of the compressor above it is also performed an automatic determination of desired flushing air flow based on various parameters by means of a control unit. The desired flushing air flow can alternatively be determined by means of the operator of the rock drilling apparatus, whereby a desired flow can be entered from the operator position such as an operator cabin, e.g. Via a MMI interface, and where the input value can be based on operator experience.

The invention has been described above in connection to a surface drilling rig which carries, a drilling machine in the form of a top hammer drilling machine. The invention, however is also suitable for compressor control, e.g., at DTH (Down-The-Hole) drilling machines. With regard to DTH drilling machines, it can be advantageous to control the discharged pressure rather than the flow, since the compressor flow powers an air-driven, percussion*mechanism in the hole, and where it is desired to maintain a desired working pressure of the percussion mechanism, however still by controlling the flow according to the above.

There are also surface solutions of the kind shown in FIG. 1 where the top hammer drilling machine is air-driven, whereby pressure control can be preferable for similar reasons.

The invention claimed is:

1. Method for controlling a compressor at a rock drilling apparatus, said rock drilling apparatus including a power source for driving a first consumer at a rock drilling process, said first consumer being a compressor and said compressor being arranged to operate according to a first mode and according to a second mode, wherein, in said first mode, the work produced by the compressor is arranged to be controlled by a control device in communication with said compressor by controlling rotation speed of said compressor, and wherein, in said second mode, the work produced by the compressor is arranged to be controlled by controlling air flow at an inlet of the compressor, the method including:

determining a first parameter value representing a demand of work from said compressor, controlling the compressor by the control device according to said first mode when said first parameter value representing a demand of work from said compressor exceeds a first demand, and controlling the compressor by the control device according to said second mode when said first parameter value representing a demand of work from said compressor is lower than said first demand;

wherein said rock drilling apparatus includes at least a second consumer being driven by said power source, wherein the method further includes determining a lowest speed of said power source that is required for operation of said at least one second consumer, wherein control according to said second mode is performed when said first parameter value is below the work that the compressor delivers at said determined lowest speed of said power source, and wherein control according to said first mode is performed when said first parameter value equals or exceeds the work that the compressor delivers at said determined lowest speed of said power source.

2. Method according to claim 1, wherein said first parameter value represents a pressure or flow demand.

3. Method according to claim 1, wherein said first parameter value represents a pressure or flow demand, where said flow demand is determined independent from a prevailing pressure in a flow circuit after the compressor.

4. Method according to claim 3, wherein, when said pressure in the flow circuit after the compressor is lower than a first pressure, said flow demand is determined independent from said prevailing pressure in the flow circuit after the compressor.

5. Method according to claim 1, wherein the method further includes changing said demand for work during operation.

6. Method according to claim 1, wherein said rock drilling process includes at least the subprocesses flushing and at least one of percussion and rotation.

7. System for controlling a compressor at a rock drilling apparatus, said rock drilling apparatus including a power source for driving a first consumer at a rock drilling process, said first consumer being a compressor, said system including:

a control device for controlling said compressor according to a first mode and according to a second mode, wherein, in said first mode, the work produced by the compressor is arranged to be controlled by controlling rotation speed of said compressor, and wherein, in said second mode, the work produced by the compressor is arranged to be controlled by controlling air flow at an inlet of the compressor, said control device controlling the compressor according to said first mode when a parameter value representing a demand of work from said compressor exceeds a first demand, and said control device controlling the compressor according to said second mode when said parameter value representing a demand of work from said compressor is lower than said first demand, said control device determining a lowest speed of said power source that is required for operation of said at least one second consumer arranged to be driven by said power source, and said control device controlling the compressor according to said second mode when said parameter value is below the work that the compressor delivers at said determined lowest speed of said power source, and controlling the compressor according to said first mode when said parameter value equals or exceeds the work that the compressor delivers at said determined lowest speed of said power source.

8. System according to claim 7, wherein said rock drilling apparatus includes at least a second consumer being driven by said power source.

9. System according to claim 7, further including means for, when controlling according to said second mode, controlling the air flow at the compressor inlet.

10. System according to claim 7, further including means for, when controlling according to said second mode, controlling the air flow at the compressor inlet by controlling an opening area of the compressor inlet towards the surroundings.

11. System according to claim 10, wherein the pressure in the compressor inlet is arranged to be controlled by controlling the opening area of the compressor inlet towards the surroundings by an electrically controllable valve.

12. System according to claim 7, further including means for, when controlling according to said first mode, controlling the rotation speed of said compressor by controlling rotation speed of said power source.

13. System according to claim 7, further including means for controlling the compressor according to said first or second mode based on a first electrical control signal, wherein said first electrical control signal includes a representation of a requested work to be delivered by said compressor.

14. System according to claim 13, wherein said control means for controlling the compressor consists of a control unit being arranged to deliver a second electrical control signal to control means for controlling said compressor inlet and/or speed of said power source.

15. System according to claim 13, wherein determination of said first electrical control signal is arranged to be performed at least partially based on one or more from the group: a pressure in the flow circuit, present hole depth, a representation of the rotational speed of the tool, a representation of a percussion mechanism power, hole diameter, drill string diameter, nature of the rock.

16. System according to claim 7, wherein said compressor consists of a compressor having fixed displacement.

17. Rock drilling apparatus, wherein said apparatus includes a system according to claim 7.

18. System for controlling a compressor at a rock drilling apparatus, said rock drilling apparatus including a power source for driving a first consumer at a rock drilling process, said first consumer being a compressor, said system including:

a control device for controlling said compressor according to a first mode and according to a second mode, wherein, in said first mode, the work produced by the compressor is arranged to be controlled by controlling rotation speed of said compressor, and wherein, in said second mode, the work produced by the compressor is arranged to be controlled by controlling air flow at an inlet of the compressor, said control device controlling the compressor according to said first mode when a parameter value representing a demand of work from said compressor exceeds a first demand, and said control device controlling the compressor according to said second mode when said parameter value representing a demand of work from said compressor is lower than said first demand, wherein said rock drilling apparatus includes at least one second consumer being driven by said power source; and wherein said at least one second consumer being driven by said power source is dimensioned such that the power that can be delivered by said at least one second consumer is independent from the rotation speed of the power source for rotation speeds exceeding a rotation speed $\omega e_ober$, where $\omega e_ober$ is a lower rotation speed than the speed $\omega e_max$ at which said compressor discharges maximal flow.

19. System according to claim 18, wherein said deliverable power consists of a maximum required deliverable power of said at least one second consumer in said system.

20. System according to claim 18, wherein said speed $\omega e_ober$ consists of a speed in the range 40-95% of said speed $\omega e_max$ at which said compressor discharges maximal flow.

* * * * *